US008028821B2

(12) United States Patent
Mösli et al.

(10) Patent No.: US 8,028,821 B2
(45) Date of Patent: Oct. 4, 2011

(54) APPARATUS FOR GATHERING SIGNATURES ALONG A CONVEYING SECTION OF A CIRCULATING CONVEYOR

(75) Inventors: Urs Mösli, Winterthur (CH); Thomas Bechinger, Dingelsdorf (DE)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 11/342,679

(22) Filed: Jan. 31, 2006

(65) Prior Publication Data

US 2006/0180438 A1 Aug. 17, 2006

(30) Foreign Application Priority Data

Jan. 31, 2005 (EP) ..... 05405045

(51) Int. Cl.
*B65G 49/00* (2006.01)

(52) U.S. Cl. ..... 198/644; 198/341.06; 198/442; 271/3.19; 271/14; 270/52.22; 270/52.29

(58) Field of Classification Search ..... 198/644, 198/341.09, 697; 270/52.23, 52.33, 52.26, 270/52.22; 53/117; 271/3.19, 10.1, 14
See application file for complete search history.

(56) References Cited

U.S. PATENT DOCUMENTS

| | | | | |
|---|---|---|---|---|
| 2,399,698 | A * | 5/1946 | Stein | 414/596 |
| 2,526,963 | A * | 10/1950 | Morris | 44/363 |
| 2,526,983 | A * | 10/1950 | Wait | 198/429 |
| 4,401,300 | A * | 8/1983 | Morin | 270/52.23 |
| 4,404,300 | A * | 9/1983 | Koski et al. | 524/91 |
| 4,743,005 | A * | 5/1988 | Reist | 270/52.22 |
| 5,161,790 | A * | 11/1992 | March | 270/1.02 |
| 6,220,427 | B1 * | 4/2001 | Ratz et al. | 198/861.2 |
| 6,299,154 | B1 * | 10/2001 | Ballestrazzi et al. | 270/52.24 |

FOREIGN PATENT DOCUMENTS

| | | |
|---|---|---|
| DE | 196 16 047 | 10/1997 |
| EP | 1 375 403 | 1/2004 |

* cited by examiner

*Primary Examiner* — Gene Crawford
*Assistant Examiner* — Kavel Singh
(74) *Attorney, Agent, or Firm* — Venable LLP; Robert Kinberg; Steven J. Schwarz

(57) ABSTRACT

An apparatus is provided for gathering signatures along a conveying section of a circulating conveyor provided with spaced-apart pushers that are attached to a traction mechanism. The apparatus includes a delivery station adapted for being arranged along the conveying section. The delivery station includes a downward slanted conveying path wherein the signatures are supplied via the downward slanted conveying path from the delivery station to the conveyor approximately in synchronism with movement of the circulating conveyor. The conveying path includes a convex conveying section followed by a concave conveying section in the conveying direction for the signatures.

14 Claims, 3 Drawing Sheets

APPARATUS FOR GATHERING SIGNATURES ALONG A CONVEYING SECTION OF A CIRCULATING CONVEYOR

CROSS-REFERENCE TO RELATED APPLICATION

This application claims the priority of European Application No. 05405045.5, filed on Jan. 31, 2005, the subject matter of which is incorporated herein by reference.

BACKGROUND OF THE INVENTION

The invention relates to an apparatus for gathering signatures along a conveying section of a circulating conveyor, provided with successively spaced apart pushers that are attached to a traction mechanism and are moved past delivery stations which are arranged along the conveying section. In the process, the signatures are supplied by the delivery stations, operating at approximately the same speed as the circulating conveyor, via a downward pointing, slanted feeding path to the conveyor.

Apparatuses of the aforementioned type are used, for example, for transporting signatures separated by feeders into the gathering channel of so-called gathering machines for perfect binding systems used in the graphics industry. Several delivery stations are arranged along the approximately horizontally extending gathering channel, which advance the signatures from a feeder into the gathering channel. A conveying device in the form of pushers that are attached to a circulating traction mechanism is provided in the gathering channel. The pushers push the stack of signatures gathered during the transport through the gathering channel. The signatures, supplied by the delivery stations, are stacked precisely one above the other to form complete stacks of gathered signatures since a later alignment of a completed signature stack is not reliably possible.

An apparatus of the aforementioned type is disclosed, for example, in German patent document DE 196 16 047. The signatures separated by the feeder are supplied with synchronous timing to the intake area of the delivery station, are transported by this delivery station to the gathering channel, and are deposited at a location where the stack of signatures is formed. The delivery station comprises respectively at least one driven upper and one lower belt section, between which the signatures are clamped in and conveyed. The conveying path takes the form of a straight section that is inclined relative to the gathering channel.

One disadvantage of the above arrangement relates to the curved areas of transition in the movement path for the signatures, at the intake and discharge of the conveying path. Signatures normally have a fold along the longitudinal and/or transverse edges, resulting in a reinforced area for the signatures. If a signature is subject to excessive bending stresses along the conveying path, the existing stiffness in the region of the longitudinal fold on the signature results in leaving traces of the bending which reduce the quality of the final product. In the case of signatures with only one longitudinal fold, the additional danger exists that the loosely fitted together signature components are displaced relative to each other. This disadvantage could be avoided by having a smaller inclination angle for the conveying path, but this would unfavorably affect the length of a delivery station which is not desirable for an apparatus having a plurality of delivery stations. A further disadvantage results from the contact rollers, which are spring-loaded and press the upper belt section against the lower belt section, thereby exerting high Hertzian stresses onto the print products. In particular with freshly imprinted signatures, the printing ink leaves impressions on the contacting sheet.

SUMMARY OF THE INVENTION

It is therefore an object of the present invention to design an apparatus of the aforementioned type, such that the signatures are conveyed carefully, without loss of quality, and to avoid mutual displacement of the signature components as well as blotting off, wherein the apparatus should also have a short structural length.

The above and other objects are accomplished according to the invention by the provision of an apparatus for gathering signatures along a conveying section of a circulating conveyor provided with spaced-apart pushers that are attached to a traction mechanism, the apparatus comprising: a delivery station adapted for being arranged along the conveying section, the delivery station including a downward slanted conveying path wherein the signatures are supplied via the downward slanted conveying path from the delivery station to the conveyor with approximately the same timing, wherein the conveying path includes a convex conveying section and a following concave conveying section in the conveying direction for the signatures.

BRIEF DESCRIPTION OF THE DRAWINGS

The invention is explained in the following with reference to the drawing, to which reference is made for all details not further mentioned in the specification, and with the aid of an exemplary embodiment.

DETAILED DESCRIPTION OF THE INVENTION

Figure 1:
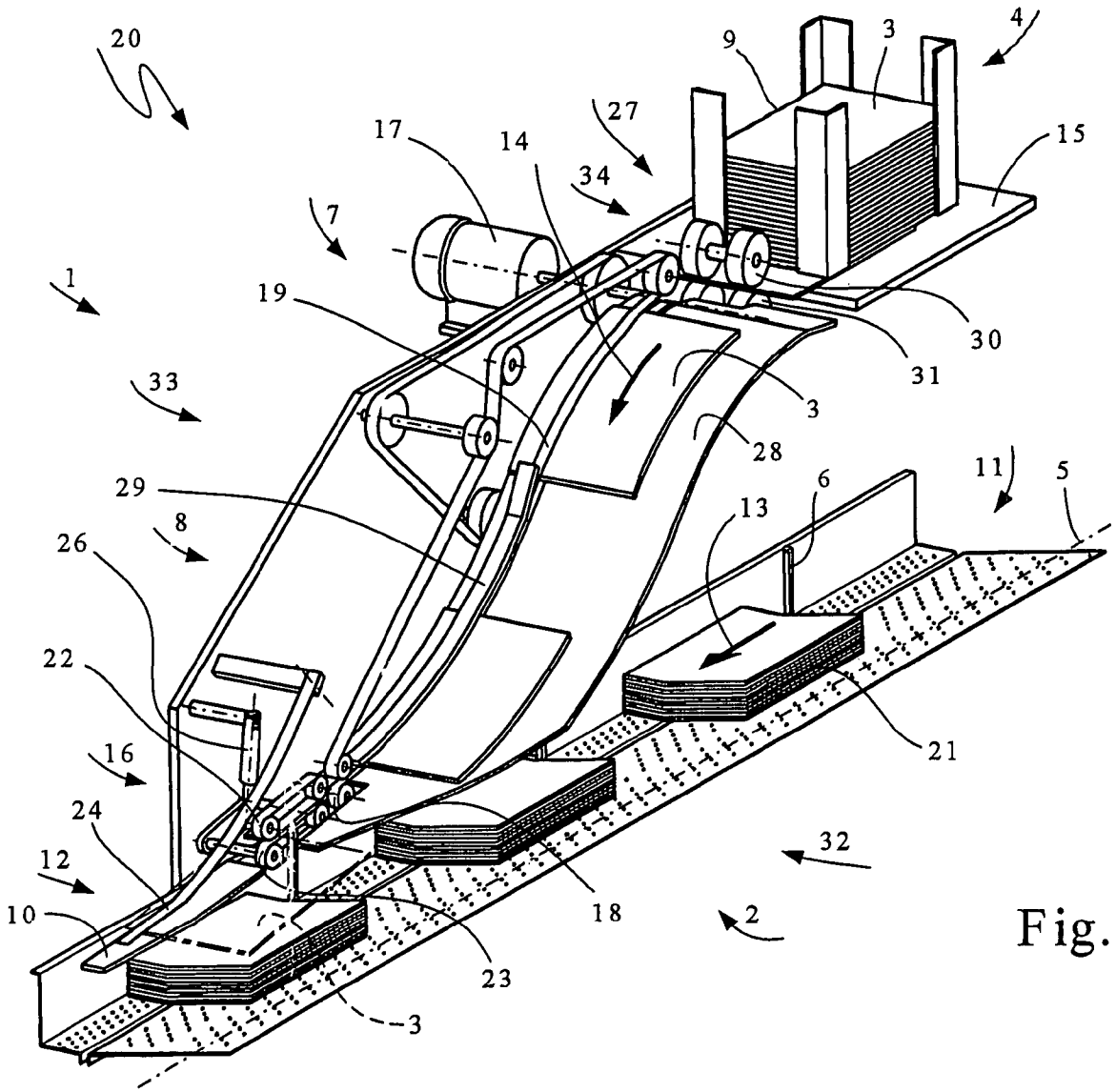
FIG. 1 shows a three-dimensional representation of a portion of the apparatus according to the invention.
Figure 2:
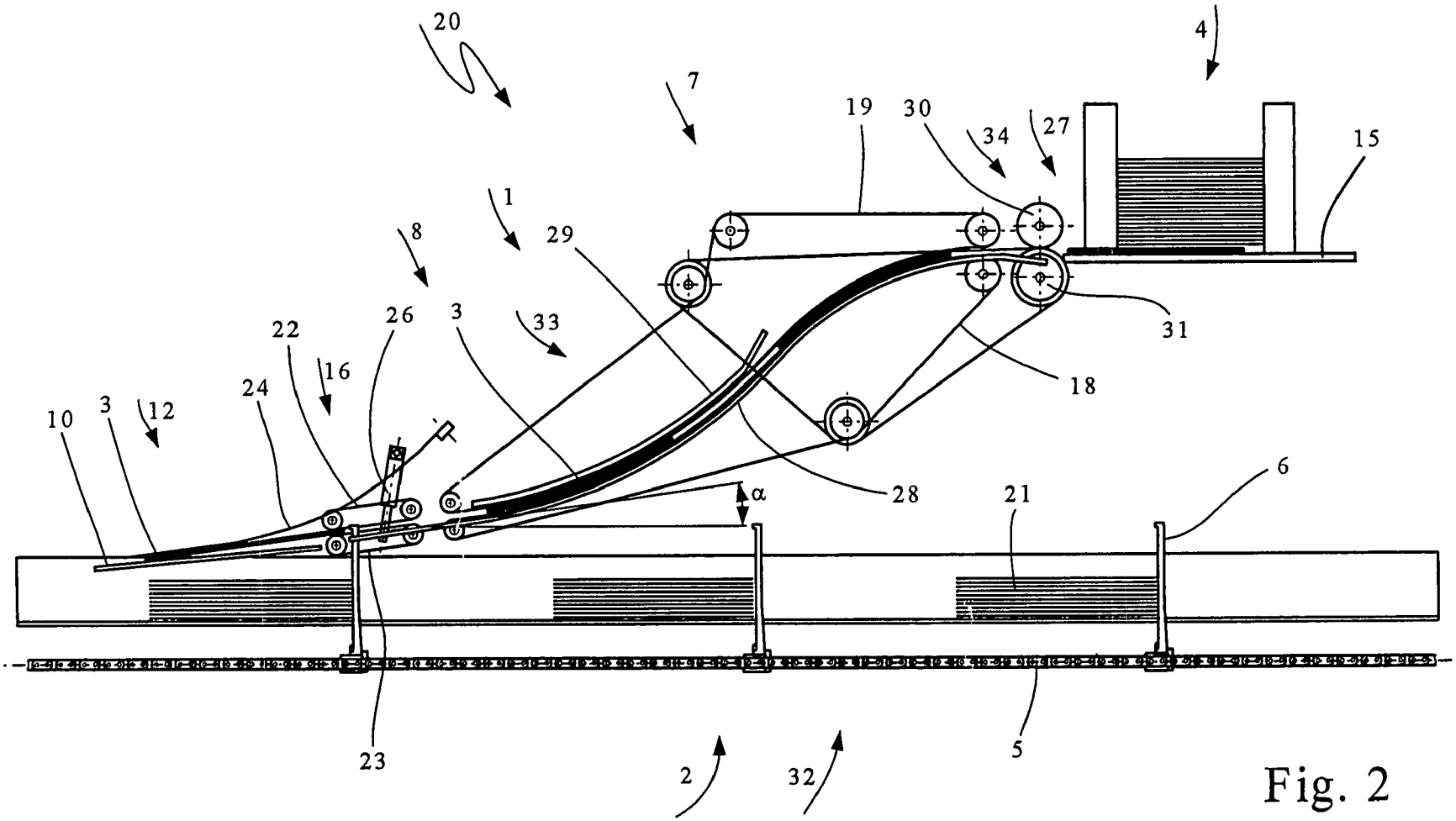
FIG. 2 shows a view from the side of the apparatus illustrated in FIG. 1.
Figure 3:
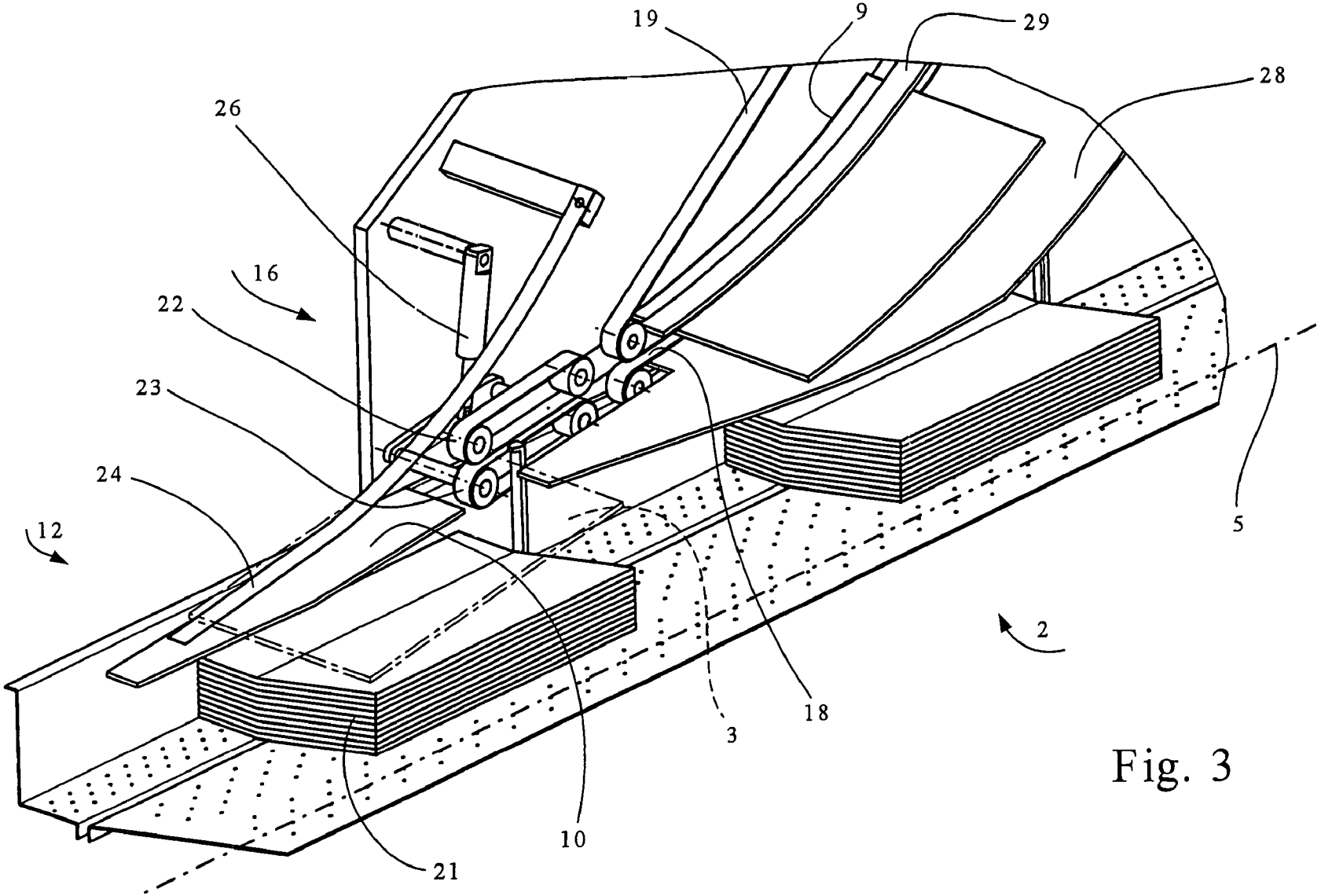
FIG. 3 shows an enlarged detail of the apparatus shown in FIG. 1.

Referring to FIGS. 1-3, there is shown a delivery station 20 including a feeder 4, comprising a discharging location 27 for discharging signatures 3 and a delivery attachment 1 for supplying the signatures 3 to a conveying section 2. The conveying section 2 is formed by a slightly V-shaped gathering channel 11 (visible in FIGS. 1 and 3) and pushers 6 which are attached to a circulating traction mechanism 5, which push the continuously forming stacks of gathered signatures 21 in a conveying direction 13 through a gathering channel 11.

The signatures 3 to be processed are automatically or manually advanced to the feeder 4 to form a stack on a table 15. The signatures 3 are supplied by the feeder 4 to a conveying element 34, consisting of upper and lower withdrawing rollers 30 and 31, respectively, with the same timing as (i.e. in synchronism with) the conveying section 2 and/or conveyor 32. The delivery apparatus 1 comprises a conveying path 33 following conveying element 34 and formed with a lower belt section 18 and an upper belt section 19. The conveying path 33 includes a convex conveying section 7 followed by a concave conveying section 8. The conveying path 33 is followed by a slightly inclined and preferably adjustable guide table 10, which is preceded by a feed conveyor 16, comprising an upper conveying section 22 and a lower conveying section 23.

The signatures 3 are transported through the conveying element 34 in the direction of discharge from the feeder 4, thus avoiding any excessive bending of the signatures 3 transverse to the longitudinal fold 9 and simultaneously keeping the length of the conveying path 33 short. In the region of the belts 18, 19, the signatures 3 are guided while clamped against the guide element 28. The belts 18, 19 together with the withdrawing rollers 30, 31 are driven at approximately the same speed by a drive motor 17. In the convex conveying section 7 of conveying path 33, the belts 18, 19 (see in particular FIG. 3) rest on the guide element 28 while in the concave conveying section 8, they fit against on the belt guide 29. The force required for clamping in the signatures 3 between the belts 18, 19 is generated automatically owing to the previously described flat S-shape of the belt guide and the pre-tensioning of belts 18, 19, without requiring additional means. As soon as the signatures 3 leave the belts 18, 19 at the end of conveying path 33, they are gripped by the feed conveyor 16, formed with conveying belts 22, 23, and are transported further with the speed of pushers 6. The conveying belts 22, 23 must be ready for the conveying operation precisely at the instant when the signatures 3 leave the belts 18, 19. An adjustment drive 26 is provided for this purpose, which causes the conveying belts 22, 23 to move toward each other and also away from each other at the correct time for the cyclical sequence. For the exemplary embodiment, the adjustment drive 26 comprises a pneumatic cylinder which is activated by a control that is not shown herein. However, other types of drives are conceivable as well, e.g. a servo drive, an electromagnetic drive, or a mechanical cam drive. A brake element 12 clamps the signatures lightly against the guide table 10, thus generating a frictional force which orients the signatures 3 on the pushers 6 in conveying direction 13 once they leave the feed conveyor 16. Leaf springs 24 which press the signatures 3 against the guide table 10, for example, are provided as a brake element. It is furthermore conceivable to press the signatures 3 with the aid of blowing air against the guide table 10 or to hold them against the guide table 10 by means of suction. The signatures 3 are aligned cleanly against the pushers 6 before they are deposited on the stacks of gathered signatures 21.

According to one exemplary embodiment of the invention, the conveying speed for the signatures 3 during the transport along the conveying path 33 can differ from the timing of the feeder 4, for example to increase the speed for conveying the signatures 3 away from the feeder 4. As a result, more time can be made available for the operation of separating the signatures in the feeder 4, so that the acceleration values can be reduced and the operational safety can be increased.

It will be understood that the above description of the present invention is susceptible to various modifications, changes and adaptations, and the same are intended to be comprehended within the meaning and range of equivalents of the appended claims.

What is claimed is:

1. An apparatus for gathering signatures, comprising:

a feeder that forms a stack of the signatures, the feeder including a discharge location for the signatures;

a conveyor comprising a gathering channel for the stack of signatures, a circulating traction mechanism that extends along the gathering channel, and spaced-apart pushers attached to the traction mechanism, wherein the circulating traction mechanism moves the pushers along the gathering channel;

a delivery station arranged along the conveying section, the delivery station including a downward slanted conveying surface wherein the signatures are supplied over the downward slanted conveying surface from the feeder to the conveyor approximately in synchronism with the movement of the pushers, wherein the downward slanted conveying surface includes a first end located adjacent the discharge location of the feeder, and a second end located adjacent the conveyor, the second end being located downward from the first end;

wherein the downwardly slanted conveying surface includes a convex conveying section located adjacent the first end followed by a concave conveying section located adjacent the second end in the conveying direction for the signatures, wherein the convex conveying section conveys the signatures in a convex direction, and the concave conveying section conveys the signatures in a concave direction.

2. The apparatus as defined in claim 1, wherein the second end of the downward slanted conveying surface is aligned at a flat angle ($\alpha$) to the conveying section.

3. The apparatus as defined in the claim 1, wherein the delivery station further includes a feed conveyor arranged at the second end of the conveying surface and which operates in synchronism with the conveyor.

4. The apparatus as defined in claim 1, wherein the delivery station further includes a guide table located at an end of the conveying surface, the guide table being adjustable with respect to position.

5. The apparatus as defined in claim 1, wherein the delivery station further includes a conveying element located at the first end of the conveying surface.

6. The apparatus as defined in claim 1, wherein the delivery station includes a locally fixed guide element by which the convex and the concave conveying sections are formed.

7. The apparatus as defined in the claim 1, wherein the delivery station includes a locally fixed belt guide arranged above the concave conveying section.

8. The apparatus as defined in claim 1, wherein the delivery station further includes opposite-arranged, driven belts arranged to clamp in the signatures along the conveying surface.

9. The apparatus as defined in claim 8, wherein the delivery station further includes a conveying element located at the first end of the conveying surface, and wherein the conveying element and the driven belts are driven with the same speed.

10. The apparatus as defined in claim 9, wherein the speed of the conveying element and the belts are changeable relative to the speed of the conveyor.

11. The apparatus as defined in claim 3, wherein the feed conveyor includes an upper conveying belt and a lower conveying belt.

12. The apparatus as defined in claim 11, wherein the speed of the conveying belts approximately corresponds to the speed of the conveyor.

13. The apparatus as defined in claim 11, wherein the delivery station further includes an adjustment device operatively associated with the conveying belts to aid in the adjustment of the conveying belts relative to each other.

14. The apparatus as defined in claim 4, wherein the delivery station further includes a brake element operatively arranged with the guide table to act upon the signatures.

* * * * *